United States Patent [19]

Amend et al.

[11] Patent Number: 4,463,567

[45] Date of Patent: Aug. 7, 1984

[54] POWER PRODUCTION WITH TWO-PHASE EXPANSION THROUGH VAPOR DOME

[75] Inventors: William E. Amend, Rolling Hills Estates; Stephen J. Toner, Los Angeles, both of Calif.

[73] Assignee: Transamerica Delaval Inc., Lawrenceville, N.J.

[21] Appl. No.: 348,817

[22] Filed: Feb. 16, 1982

[51] Int. Cl.[3] ..... F01K 25/00

[52] U.S. Cl. ..... 60/671; 60/716

[58] Field of Search ..... 60/645, 647, 651, 671, 60/698, 716, 653

[56] References Cited

U.S. PATENT DOCUMENTS

| | | | |
|---|---|---|---|
| 2,258,167 | 10/1941 | Turner | 60/677 |
| 3,234,734 | 2/1966 | Buss et al. | 60/651 |
| 3,636,706 | 1/1972 | Minto | 60/651 |
| 3,702,534 | 11/1972 | Bechtold | 60/651 |
| 4,063,417 | 12/1977 | Shields | 60/715 X |
| 4,087,261 | 5/1978 | Hays | 55/41 |
| 4,118,934 | 10/1978 | Brola | 60/647 |
| 4,170,116 | 10/1979 | Williams | 60/671 X |
| 4,227,373 | 10/1980 | Amend et al. | 60/618 |
| 4,258,551 | 3/1981 | Ritzi | 60/654 |
| 4,298,311 | 11/1981 | Ritzi | 415/80 |

*Primary Examiner*—Stephen F. Husar

*Attorney, Agent, or Firm*—William W. Haefliger

[57] ABSTRACT

In a system wherein a fluid exhibits a regressive vapor dome in a T-S diagram, the following are provided:

(a) a two-phase nozzle receiving the fluid in pressurized and heated liquid state and expanding the received liquid into saturated or superheated vapor state, and (b) apparatus receiving the saturated or superheated vapor to convert the kinetic energy thereof into power.

7 Claims, 4 Drawing Figures

POWER PRODUCTION WITH TWO-PHASE EXPANSION THROUGH VAPOR DOME

BACKGROUND OF THE INVENTION

This invention relates generally to power production, and more particularly concerns use of a two-phase nozzle in a process employing a fluid exhibiting a regressive vapor dome in the temperature-entropy plane.

Conventional vapor turbines operating in systems utilizing waste heat as energy sources encounter a pinch point problem in transferring the energy from the waste heat to the working fluid. The problem is a result of the heat of vaporization that must be absorbed to vaporize the working fluid as shown in FIG. 1, so that the energy can be transformed into shaft work in a vapor turbine. As a result, there always exists a large temperature difference between the temperature of the exhaust gas and the working fluid (see $\Delta T_{pp}$ on FIG. 1). This limits the upper temperature of the working fluid which in turn limits the thermodynamic efficiency of the system.

SUMMARY OF THE INVENTION

It is a major object of the invention to provide a power producing system and process wherein the working fluid exhibits a regressive saturated vapor line, i.e. one wherein the entropy decreases as the temperature of the saturated vapor decreases. Basically, the invention involves the use of a two-phase nozzle in such a system, and includes the steps:

(a) receiving the fluid in pressurized and heated liquid state in a two-phase nozzle, and expanding the received liquid therein into a discharge jet consisting of saturated or superheated vapor, (b) and converting the kinetic energy of said vapor jet into power.

In this regard, the use of a fluid with a regressive vapor dome eliminates the above described problem, and as further shown in FIG. 2. The fluid exiting the heat exchanger is in the liquid state. Expansion through a two-phase nozzle from state points 1 to 2 results in a high velocity pure vapor at the nozzle exit.

As will be seen, the working fluid is typically a hydrocarbon or a fluorocarbon, examples being DOWTHERM-A or certain freons and the two-phase nozzle facilitates production of a jet consisting substantially completely of superheated vapor, whereby turbine efficiency can be increased. Overall turbine efficiency is enhanced by provision of both impulse and reaction turbine stages, as will be seen.

These and other objects and advantages of the invention, as well as the details of an illustrative embodiment, will be more fully understood from the following specification and drawings, in which:

DRAWING DESCRIPTION

DETAILED DESCRIPTION

Figure 1:
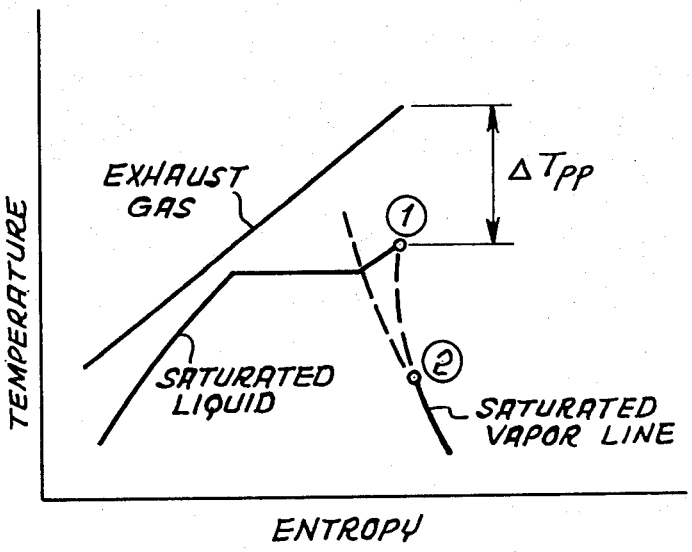
FIG. 1 is a temperature-entropy diagram.
Figure 2:
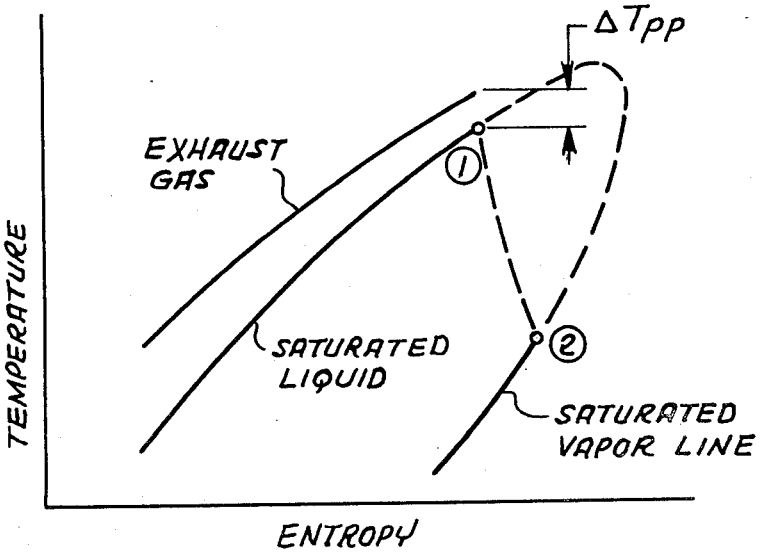
FIG. 2 is a temperature-entropy diagram.
Figure 3:
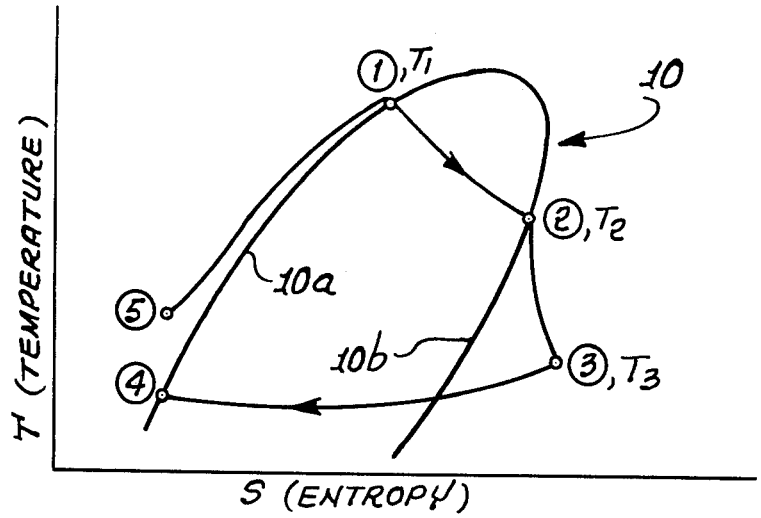
FIG. 3 is a temperature-entropy diagram.

Referring first to FIG. 3, a temperature-entropy curve 10 is shown for a fluid having a regressive vapor dome. The line 10*a* defining the left side of the curve 10 corresponds to saturated liquid, and the regressive line 10*b* defining the right side of the curve 10 corresponds to saturated vapor. Some fluids may exhibit T-S curves such as shown at 10, and examples are the liquid mix known as DOWTHERM-A (a product of Dow Chemical Company, Midland, Mich.); certain fluoro-carbons and other hydrocarbon liquid mixes. Typical fluorocarbons are: R 114, R 216 and trifluoroethanol.

Fluids with regressive vapor domes as shown can be expanded from their saturated liquid state (line 10*a*) through the vapor dome into the superheat region (to line 10*b*, for example).

Figure 4:
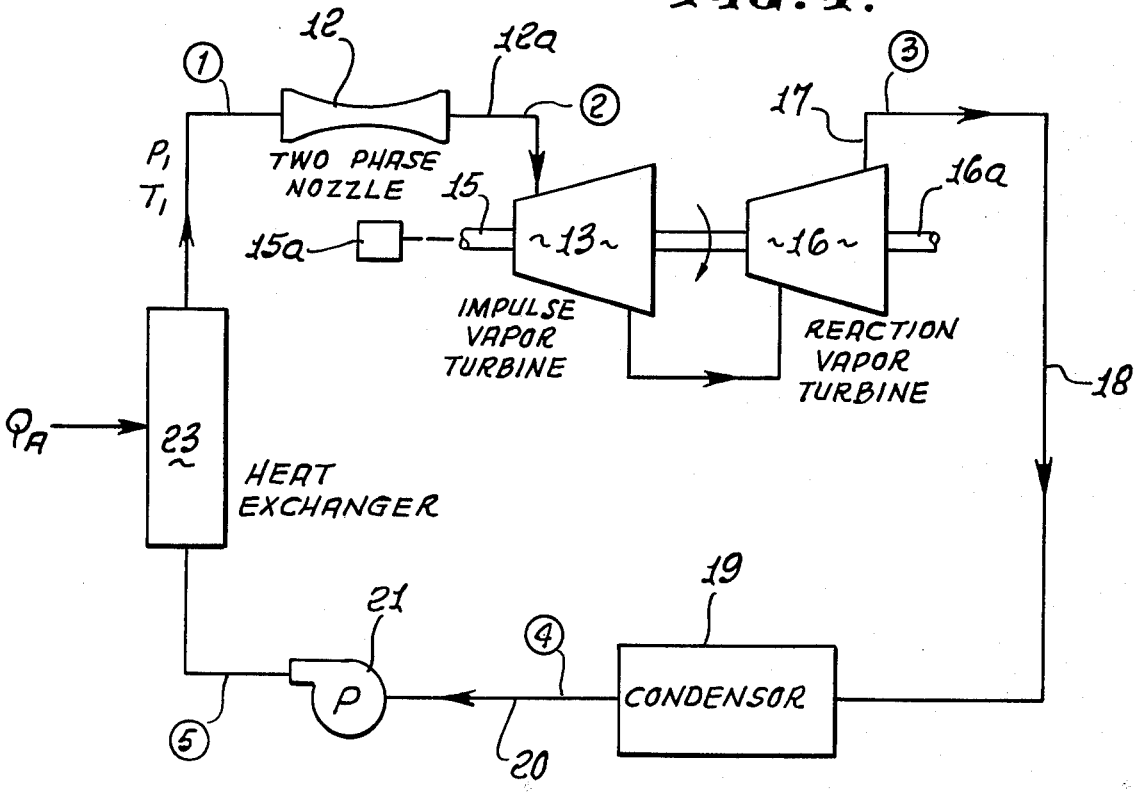
FIG. 4 is a schematic showing of a vapor turbine system.

In accordance with the invention, a two-phase nozzle 12 is employed as in FIG. 4 to carry out the expansion through the vapor dome, as referred to. Examples of such nozzles are those described in U.S. Pat. No. 3,879,949. Such expansion can take place at high efficiency (such as about 90%) to yield a vapor jet at 12*a* with velocities of discharged vapor in the range of about 1000 feet per second. Such jet velocities are not excessive, the latent heat of vaporization of such fluids typically being around 100 B/lbm, where:

B = British thermal unit lbm = pound mass

As shown in FIG. 4 the jet is passed to turbine means to convert the kinetic energy of the jet into power. See for example the impulse vapor turbine 13 receiving the superheated vapor jet, and discharging it at 14. A power take-off shaft is indicated at 15, and may be used to drive a pump, generator, etc., indicated at 15*a*. See also the reaction vapor turbine 16 connected in series with turbine 13 to receive the vapor discharge 14, and discharge the reduced temperature vapor at 17. See point ③ in both FIGS. 3 and 4. Both turbines are thereby driven, the power take-off for reaction vapor turbine 16 being indicated at 16*a*.

In general, in an impulse vapor turbine, the total pressure drop for a stage is taken across elements or blades (stators), whereas in a reaction turbine, the total pressure drop for a stage is divided between stationary blades and rotating blades, these two types of turbines being well known per se.

Referring to FIG. 4 the vaporized and discharge fluid 17 is then passed at 18 to a condenser 19, the condensate 20 being re-pumped at 21 to a pressure $p_1$ equal to the pressure of liquid entering the nozzle 12. Prior to passage to the nozzle, the liquid is heated in a heat exchanger 23 to initial temperature $T_1$. Heat added to the liquid in exchanger 23 is indicated at $Q_A$. Also, note corresponding points ③, ④ and ⑤ in FIGS. 3 and 4.

The advantages of the described system include:

(1) provision of high efficiency without the need for boilers or regenerators, enabling the system to operate at high upper cycle temperature for a given heat-source temperature.

(2) Spouting (nozzle jet) velocities can be limited to about 1000 ft/sec.

(3) Use of conventional turbines, as described.

(4) Nozzle efficiency is high (typically greater than 90%) because mostly vapor flows through the diverging section of the nozzle.

A summary of temperatures and efficiencies is set forth in the following

TABLE

| Fluid | $T_1$(°F.) | $T_2$ | $T_3$ | $T_{condenser}$ |
|---|---|---|---|---|
| Dowtherm A | 750 | 500 | 256 | 110 |
| Dowtherm A | 680 | 401 | 216 | 110 |
| Dowtherm E | 630 | 240 | 128 | 120 |

TABLE-continued

| Fluid | efficiency | | | |
|---|---|---|---|---|
| | $\eta_\eta$ | $\eta_{t1}$ | $\eta_{t2}$ | $\eta_{cycle}$ |
| Dowtherm A | 0.8 | 0.8 | 0.8 | .267 |
| Dowtherm A | 0.8 | 0.9 | 0.9 | .297 |
| Dowtherm E | 0.8 | 0.9 | 0.9 | .244 |

where
$\eta_\eta$ = nozzle efficiency
$\eta_{t1}$ = efficiency of impulse turbine
$\eta_{t2}$ = efficiency of reaction turbine
$\eta_{cycle}$ = overall thermodynamic efficiency of cycle

We claim:

1. In a system wherein a fluid exhibits a regressive vapor dome in a T-S diagram, the combination comprising (a) a two-phase nozzle receiving said fluid in a pressurized and heated liquid state and expanding said received liquid into a saturated or superheated vapor state in a vapor jet, and (b) turbine means receiving only said saturated or superheated vapor in jet form to convert the kinetic energy thereof into power, (c) said nozzle being separate from the turbine means so that said jet is formed before its reception in the turbine means.

2. The combination of claim 1 wherein said turbine means includes an impulse vapor turbine receiving said vapor jet to drive the turbine.

3. The combination of claim 2 wherein said turbine means also includes a reaction vapor turbine receiving the vapor discharged from said impulse vapor turbine, to drive the reaction vapor turbine.

4. The combination of claim 1 including other means operatively connected with said turbine means for condensing the expanded vapor, for re-pressurizing and heating same for re-delivery to said nozzle.

5. The combination of claim 3 including other means operatively connected between said reaction vapor turbine and said nozzle for condensing the expanded vapor and for re-pressurizing and heating same for re-delivery to the nozzle.

6. The combination of claim 5 wherein said other means comprises a condenser, a pump and a heater, connected in series.

7. The combination of claim 1 including said fluid which is selected from the group that includes hydrocarbon fluids and fluorocarbon fluids.

* * * * *